US009174888B2

(12) United States Patent
Wu et al.

(10) Patent No.: US 9,174,888 B2
(45) Date of Patent: Nov. 3, 2015

(54) GAS GENERATING COMPOSITION

(75) Inventors: Jianzhou Wu, Hyogo (JP); Shogo Tomiyama, Hyogo (JP); Yoji Fujisaki, Hyogo (JP)

(73) Assignee: DAICEL CHEMICAL INDUSTRIES, LTD., Osaka-shi (JP)

( * ) Notice: Subject to any disclaimer, the term of this patent is extended or adjusted under 35 U.S.C. 154(b) by 0 days.

(21) Appl. No.: 12/937,072

(22) PCT Filed: Apr. 8, 2009

(86) PCT No.: PCT/JP2009/001621

§ 371 (c)(1),
(2), (4) Date: Oct. 8, 2010

(87) PCT Pub. No.: WO2009/125587

PCT Pub. Date: Oct. 15, 2009

(65) Prior Publication Data

US 2011/0030858 A1 Feb. 10, 2011

(30) Foreign Application Priority Data

Apr. 11, 2008 (JP) ..... 2008-103537
Mar. 23, 2009 (JP) ..... 2009-069967

(51) Int. Cl.

| | |
|---|---|
| ***C06B 31/00*** | (2006.01) |
| ***C06B 45/04*** | (2006.01) |
| ***C06B 31/02*** | (2006.01) |
| ***C06B 23/04*** | (2006.01) |
| ***C06D 5/06*** | (2006.01) |

(52) U.S. Cl.
CPC ..... *C06B 23/04* (2013.01); *C06B 31/00* (2013.01); *C06B 31/02* (2013.01); *C06B 45/04* (2013.01); *C06D 5/06* (2013.01)

(58) Field of Classification Search
CPC ..... C06B 31/00; C06B 45/04; C06B 31/02
See application file for complete search history.

(56) References Cited

U.S. PATENT DOCUMENTS

| | | | | |
|---|---|---|---|---|
| 3,589,954 | A * | 6/1971 | Fillter | 149/19.4 |
| 3,862,866 | A * | 1/1975 | Timmerman et al. | 149/21 |
| 5,817,972 | A | 10/1998 | Butt et al. | |
| 6,605,233 | B2 * | 8/2003 | Knowlton et al. | 252/181.1 |
| 2004/0123925 | A1 | 7/2004 | Wu | |
| 2004/0154712 | A1 * | 8/2004 | Yokoyama et al. | 149/45 |
| 2005/0155681 | A1 | 7/2005 | Wu | |

FOREIGN PATENT DOCUMENTS

| | | | |
|---|---|---|---|
| CN | 1247525 | A | 3/2000 |
| EP | 1 538 137 | A1 | 6/2005 |
| FR | 2 862 637 | A1 | 5/2005 |
| GB | 1301296 | A | 12/1972 |
| JP | 9-165287 | A | 6/1997 |
| JP | 2004-155645 | A | 6/2004 |
| WO | WO 98/06486 | A2 | 2/1998 |

OTHER PUBLICATIONS

International Search Report for PCT/JP2009/001621 mailed May 12, 2009.
International Preliminary Report on Patentability issued Nov. 30, 2010, in PCT International Application No. PCT/JP2009/001621.
Extended European Search Report for European Application No. 09730137.8 dated Dec. 4, 2013.

* cited by examiner

*Primary Examiner* — Aileen B Felton
(74) *Attorney, Agent, or Firm* — Birch Stewart Kolasch & Birch, LLP

(57) ABSTRACT

A gas generating composition exhibiting good slag forming ability is provided.
The gas generating composition includes a fuel ranging from 10 to 60% by mass, an oxidizing agent ranging from 10 to 70% by mass, and a cooling agent (other than iron oxide) ranging from 1 to 20% by mass. The cooling agent has a volume mean diameter (D50) of 10 to 70 μm and a volume mean diameter at cumulative of 10% (D10) of equal to or greater than 5 μm. The cooling agent acts to decrease the combustion temperature and improve slag forming ability.

5 Claims, No Drawings

GAS GENERATING COMPOSITION

TECHNICAL FIELD

The present invention relates to a gas generating composition suitable for an inflator used in an airbag apparatus of a vehicle.

BACKGROUND ART

A combustion temperature of a gas generating agent should be decreased in order to obtain an inflator for a vehicle airbag having a reduced size and weight. The combustion temperature can be decreased by adding a cooling agent (an additive for decreasing the combustion temperature), but this sometimes results in increase of the generated amount of mist (solid components discharged when the inflator is actuated).

JP-A 9-165287 discloses a gas generating composition including iron oxide as a cooling agent, wherein 50% by mass or more of the iron oxide have a mean particle diameter of larger than 100 μm.

JP-A 2004-155645 discloses a gas generating composition including aluminum hydroxide as a component for decreasing the combustion temperature and also improving ignition ability. It is described that the average particle diameter (D50) of aluminum hydroxide is preferably 0.1 to 70 μm, more preferably 0.5 to 50 μm, even more preferably 2 to 30 μm, but a particle size distribution is not described.

DISCLOSURE OF THE INVENTION

The present invention provides a gas generating composition capable of decreasing the combustion temperature of a gas generating agent, improving ignition ability, and reducing the generated amount of mist.

The present inventors have discovered that, by improving the invention disclosed in JP-A 2004-155645, which is a prior invention filed by the applicant of the present invention, and adjusting the particle size distribution of a cooling agent, it is possible to decrease the combustion temperature of the gas generating agent and also improve the ignition ability and increase the slag forming ability of combustion residue, thereby enabling the decrease in the generated amount of mist. This finding led to the creation of the present invention.

The present invention provides:

1. a gas generating composition, containing a fuel, an oxidizing agent, and a cooling agent other than iron oxides, wherein the cooling agent has a volume mean diameter (D50) of 10 to 70 μm and a volume mean diameter at cumulative of 10% (D10) of equal to or greater than 5 μm.

The present invention also provides use of the above shown composition for a gas generating agent.

DETAILED DESCRIPTION OF THE INVENTION

The gas generating composition in accordance with the present invention includes a cooling agent having a predetermined particle size distribution. As a result, it is possible to decrease the combustion temperature of the gas generating agent and also improve the ignition ability and increase the slag forming ability of combustion residue, thereby enabling the decrease in the amount of generated mist.

The composition in accordance with the present invention and a molded article obtained therefrom can be used, for example, in an airbag inflator of a driver seat, an airbag inflator of a passenger seat next to the driver, a side airbag inflator, an inflator for an inflatable curtain, an inflator for a knee bolster, an inflator for an inflatable seat belt, an inflator for a tubular system, and a gas generator for a pretensioner, of various vehicles.

The inflator using the composition in accordance with the present invention or a molded article obtained therefrom may be of a pyrotechnic type in which a gas supplying source is only a gas generating agent and of a hybrid type which uses both a compressed gas such as argon and a gas generating agent.

Further, the composition in accordance with the present invention or a molded article obtained therefrom can be also used as an igniting agent called an enhancer or a booster, serving to transmit the energy of a detonator or a squib to the gas generating agent.

The present invention includes the following embodiments 2 to 7 of the above shown invention 1.

2. The gas generating composition according to invention 1, wherein the volume mean diameter at cumulative of 10% (D10) is 5 to 40 μm.

3. The gas generating composition according to invention 1 or embodiment 2, wherein the cooling agent is at least one selected from metal hydroxides, metal carbonates, metal oxalates, and complex salts of these compounds.

4. The gas generating composition according to any one of invention 1 or embodiment 2 or 3, wherein the content ratio of the fuel is 10 to 60% by mass, the content ratio of the oxidizing agent is 20 to 70% by mass, and the content ratio of the cooling agent is 1 to 20% by mass.

5. The gas generating composition according to any one of invention 1 or embodiments 2 to 4, further comprising 0.5 to 15% by mass of a binder.

6. The gas generating composition according to any one of invention 1 or embodiments 2 to 5, further comprising 0.1 to 5% by mass of powdered glass.

7. The gas generating composition according to any one of invention 1 or embodiments 2 to 6, further comprising 0.1 to 5% by mass of at least one selected from metal phosphates.

<Fuel>

The fuel used in accordance with the present invention can be a known fuel for a gas generating composition, for example, at least one selected from tetrazole compounds, guanidine compounds, triazine compounds, and nitroamine compounds.

Preferred tetrazole compounds include 5-aminotetrazole and bitetrazole ammonium salt. Preferred guanidine compounds include guanidine nitric acid salt (guanidine nitrate), aminoguanidine nitrate, nitroguanidine, and triaminoguanidine nitrate. Preferred triazine compounds include melamine, cyanuric acid, ammeline, ammelide, and ammelande. Preferred nitroamine compounds include cyclo-1,3,5-trimethylene-2,4,6-trinitramine.

<Oxidizing Agent>

The oxidizing agent used in accordance with the present invention can be a known oxidizing agent for a gas generating composition and at least one selected from basic metal nitrates, nitrates, ammonium nitrate, perchlorates, and chlorates.

The basic metal nitrate can be at least one selected from basic copper nitrate, basic cobalt nitrate, basic zinc nitrate, basic manganese nitrate, basic iron nitrate, basic molybdenum nitrate, basic bismuth nitrate, and basic cerium nitrate.

In order to increase the combustion speed (burning rate), it is preferred that the basic metal nitrate have an average particle diameter of equal to or less than 30 μm, more preferably equal to or less than 10 μm. The average particle diameter is measured by using a method identical to that used with respect to the cooling agent.

Nitrates can be alkali metal nitrates such as potassium nitrate and sodium nitrate and alkaline earth metal nitrates such as strontium nitrate.

Perchlorates and chlorates are components demonstrating an oxidizing action and also a combustion enhancing action. The oxidizing action means that oxygen is generated and the fuel is oxidized. The combustion enhancing action means an action enhancing the ignition ability of the gas generating composition and an action increasing the combustion speed.

At least one selected from ammonium perchlorate, potassium perchlorate, sodium perchlorate, potassium chlorate, and sodium chlorate can be used as the perchlorate and chlorate.

<Cooling Agent>

In order to solve problems, the cooling agent (other than iron oxides) used in accordance with the present invention has a volume mean diameter (D50) of 10 to 70 μm, preferably 15 to 60 μm, and more preferably 20 to 50 μm, and a volume mean diameter at cumulative of 10% (D10) of equal to or greater than 5 μm, preferably equal to or greater than 5.5 μm, and even more preferably equal to or greater than 6.0 μm. The volume mean diameter (D50) and volume mean diameter at cumulative of 10% (D10) are determined by the methods described in Examples.

The volume mean diameter (D50) of the cooling agent is equal to or less than 70 μm. This is because when the volume mean diameter is larger than this value, the ignition ability of the gas generating composition is degraded. However, even in this case, the following problem arises when the content of particles with a small diameter in the cooling agent is high (when D50 is less than 10 μm or when D10 is less than 5 μm): oxides caused by the presence of the cooling agent enclose the metal (metal as a combustion residue) during combustion and inhibit aggregation of the metal, thereby inhibiting formation of slag. However, in the cooling agent in accordance with the present invention, the content of particles with a small diameter is small (D50 is equal to or higher than 10 μm and D10 is equal to or higher than 5 μm). Therefore, by contrast with the above-described process, the metal encloses the oxides and therefore the metal easily coheres with each other and the formation of slag is facilitated. Further, where small amounts of powdered glass and a metal phosphate are present in the gas generating composition, the slag forming ability of the combustion residue can be further improved.

The volume mean diameter at cumulative of 10% (D10) of the cooling agent (except iron oxide) used in accordance with the present invention is preferably 5 to 40 μm, more preferably 5.5 to 35 μm, even more preferably 6.0 to 30 μm.

The reason why the volume mean diameter (D50) of the cooling agent is preferably equal to or greater than 10 μm is described above, but even in this case, when the content of particles with a large diameter in the cooling agent is high (D10 is greater than 40 μm), for example, when the particle size distribution of the cooling agent shifts significantly towards the side with a larger particle diameter, such a problem arises that the ignition ability is detracted. However, in the cooling agent in accordance with the present invention, this problem can be avoided when the content of particles with a large diameter is small (D10 is equal to or less than 40 μm).

The particle diameter of the cooling agent can be adjusted by using various grinding machines based on classification described, for example, in "Chemical Engineering Manual", edited by Chemical Engineering Association, Fifth Revised Edition, pages 826 to 838, Maruzen Publishing Co. When a roller mill is used for grinding, the particle diameter is adjusted by adjusting the distance between the grinding rollers. The particle diameter can be also adjusted by adjusting crystallization conditions when a crude product of the cooling agent is purified. Classification can be also conducted so as to obtain the predetermined volume mean diameter.

The cooling agent (except iron oxides) used in accordance with the present invention can be at least one selected from metal hydroxides, metal carbonates, metal oxalates, metal phosphate and complex salts of these compounds.

Preferable metal hydroxide can be at least one selected from aluminum hydroxide, magnesium hydroxide, calcium hydroxide, and zirconium hydroxide.

Preferable metal carbonate can be at least one selected from magnesium carbonate, copper carbonate, and calcium carbonate.

Preferable metal oxalate can be at least one selected from copper oxalate, magnesium oxalate, iron oxalate, and calcium oxalate.

Preferable complex salt can be at least one selected from basic magnesium carbonate and basic copper carbonate.

The content of the fuel in the composition in accordance with the present invention is preferably 10 to 60% by mass, preferably 15 to 55% by mass, more preferably 20 to 50% by mass. The content of the oxidizing agent in the composition in accordance with the present invention is preferably 20 to 70% by mass, more preferably 20 to 60% by mass, even more preferably 25 to 55% by mass. The content of the cooling agent in the composition in accordance with the present invention is preferably 1 to 20% by mass, more preferably 3 to 17% by mass, even more preferably 5 to 12% by mass.

<Binder>

If necessary, the composition in accordance with the present invention can contain a binder. The binder can be at least one selected from carboxymethyl cellulose (CMC), carboxymethyl cellulose sodium salt (CMCNa), carboxymethyl cellulose potassium salt, carboxymethyl cellulose ammonium salt, cellulose acetate, cellulose acetate butyrate (CAB), methyl cellulose (MC), ethyl cellulose (EC), hydroxyethyl cellulose (HEC), ethyl hydroxyethyl cellulose (EHEC), hydroxypropyl cellulose (HPC), carboxymethyl ethyl cellulose (CMEC), microcrystalline cellulose, polyacrylamides, aminated compounds of polyacrylamide, polyacryl hydrazide, a copolymer of acrylamide and a metal salt of acrylic acid, a copolymer of polyacrylamide and a polyacrylic acid ester, polyvinyl alcohol, acryl rubber, guar gum, starch, and silicone.

The content of the binder in the composition in accordance with the present invention is preferably 0.5 to 15% by mass, more preferably 1 to 10% by mass, and even more preferably 3 to 7% by mass.

<Powdered Glass>

If necessary, the composition in accordance with the present invention can include powdered glass. Preferable powdered glass can be at least one selected from a phosphate glass powder and a silicate glass powder.

The content of the powdered glass in the composition in accordance with the present invention is preferably 0.5 to 5% by mass, more preferably 0.7 to 3% by mass, even more preferably 0.9 to 2% by mass.

<Metal Phosphate>

If necessary, the composition in accordance with the present invention can include at least one selected from metal phosphates.

Examples of metal phosphates include primary aluminum phosphate, secondary aluminum phosphate, tertiary aluminum phosphate, aluminum meta phosphate, primary magnesium phosphate, secondary magnesium phosphate, tertiary magnesium phosphate, magnesium meta phosphate, monocalcium phosphate, dicalcium phosphate, tricalcium phosphate, complex salts of calcium phosphate and calcium hydroxide, monopotassium phosphate, dipotassium phosphate, tripotassium phosphate, potassium metaphosphate, monosodium phosphate, disodium phosphate, trisodium phosphate, sodium meta phosphate, metal polyphosphates, and metal hydrogen phosphates.

The content of the metal phosphate in the composition in accordance with the present invention is preferably 0.5 to 5% by mass, more preferably 0.7 to 3% by mass, even more preferably 0.9 to 2% by mass.

If necessary, the composition in accordance with the present invention can include a metal oxide such as copper oxide, zinc oxide, cobalt oxide, manganese oxide, molybdenum oxide, nickel oxide, bismuth oxide, silica, and alumina; a metal acid salt such as cobalt carbonate, basic zinc carbonate, Japanese acid clay, kaolin, talc, bentonite, diatomaceous earth, hydrotalcite, sodium silicate, mica molybdate, cobalt molybdate, and ammonium molybdate; molybdenum disulfide, calcium stearate, silicon nitride, and silicon carbide.

The preferred compounding examples of the composition in accordance with the present invention are shown below.

Compounding Example 1

Fuel: guanidine nitrate 35 to 45% by mass.

Oxidizing agent: basic copper nitrate 40 to 50% by mass.

Cooling agent: aluminum hydroxide 1 to 10% by mass (D50: 10 to 50 μm, D10: 5 to 30 μm).

Binder: carboxymethyl cellulose sodium salt (CMCNa) 2 to 8% by mass.

Compounding Example 2

Fuel: guanidine nitrate 35 to 45% by mass.

Oxidizing agent: basic copper nitrate 40 to 50% by mass.

Cooling agent: aluminum hydroxide 1 to 10% by mass (D50: 10 to 50 μm, D10: 5 to 30 μm).

Binder: carboxymethyl cellulose sodium salt (CMCNa) 2 to 8% by mass.

Compounding Example 3

Fuel: guanidine nitrate 35 to 45% by mass.

Oxidizing agent: basic copper nitrate 40 to 50% by mass.

Cooling agent: aluminum hydroxide 1 to 10% by mass (D50: 10 to 50 μm, D10: 5 to 30 μm).

Binder: carboxymethyl cellulose sodium salt (CMCNa) 2 to 8% by mass.

Slag formation enhancer: phosphate glass or metal phosphate 0.1 to 5% by mass.

The composition in accordance with the present invention can be molded to a desired shape and a molded article in the form of a cylinder having a single hole, a perforated (porous) cylinder, and a pellet can be obtained.

These molded articles can be manufactured by adding water or an organic solvent to the composition, mixing and extrusion-molding (molded article in the form of a cylinder having a single hole or a perforated (porous) cylinder) or compression-molding by using a pelletizer or the like (a molded article in a shape of a pellet). The molded article in the form of a cylinder having a single hole and a perforated (porous) cylinder may have a hole(s) passing through in the longitudinal direction or a hollow(s) that does not pass through.

Examples

[Methods for Measuring Volume Mean Diameter (D50) and Volume Mean Diameter at Cumulative of 10% (D10)]

The measurements were conducted by a particle size distribution measurement method based on laser scattering. A particle size meter MICROTRAC, Model No. 9320-X100, manufactured by Neede+Northrop Company, was used for the measurements. A sample was dispersed in ion-exchange water and irradiated for 60 sec with ultrasonic waves at 50 W. The 50% accumulated value and 10% accumulated value of particles' volume were found. Average values by twice measurements were taken as D50 and D10.

[Slag-Forming Ability of Combustion Residue]

A molded article of a gas generating composition with an outer diameter of about 4.7 mm, an inner diameter of about 1.2 mm, and a length of about 4.2 mm was ignited and combusted by a Nichrome wire in a nitrogen atmosphere under 686 kPa (70 kg/cm$^2$). The residue after the combustion was visually observed and evaluated according to the following criteria.

◎: lumpy residue.

○: mixture of lumps and powder.

x: almost the entire residue is powder.

(Ignition Ability)

Molded articles of a gas generating composition with 39.4 g (a single-hole article with an average outer diameter of 4.2 mm, an average inner diameter of 1.1 mm, and an average length of 4 mm) was placed in an inflator (dual cylindrical type, outer diameter 70 mm, height 33 mm, wall thickness 1.6 mm; enhancer: 1.4 g of a B/$KNO_3$ mixture, the maximum inner pressure at a temperature of 23° C. was adjusted to 9±5 MPa) on the driver side and allowed to stay for more than 2 h at a temperature of −40° C.) thereby a 60 liter tank test was performed. Where the tank pressure has not risen within 10 ms, the ignition ability was poor (x), and where the tank pressure has risen within 10 ms, the ignition ability was good (○).

Examples and Comparative Examples

Gas generating compositions including components shown in Table 1 were obtained. Slag-forming ability of the obtained compositions was tested. The combustion temperature is a numerical value obtained by theoretic calculations.

TABLE 1

| | Composition (% by mass) | particle size of aluminum hydroxide (μm) D50 | D10 | combustion temperature (K) | slag-forming ability of combustion residue | ignition ability |
|---|---|---|---|---|---|---|
| Example 1 | GN/BCN/CMCNa/$Al(OH)_3$ = 40.7/49.3/5/5 | 12.9 | 8.8 | 1700 | ○ | ○ |
| Example 2 | GN/BCN/CMCNa/$Al(OH)_3$ = 40.7/49.3/5/5 | 35.4 | 22.5 | 1700 | ◎ | ○ |
| Example 3 | GN/BCN/CMCNa/$Al(OH)_3$/phosphate glass = 39.6/46.4/5/8/1 | 34.2 | 8.3 | 1603 | ◎ | ○ |
| Example 4 | GN/BCN/CMCNa/$Al(OH)_3$/phosphate | 34.2 | 8.3 | 1623 | ◎ | ○ |

TABLE 1-continued

| | Composition (% by mass) | particle size of aluminum hydroxide (μm) D50 | D10 | combustion temperature (K) | slag-forming ability of combustion residue | ignition ability |
|---|---|---|---|---|---|---|
| | glass = 38.6/47.4/5/8/1 | | | | | |
| Example 5 | GN/BCN/$Al(OH)_3$/CMCNa/$AlPO_4$ = 38.6/47.4/5/8/1 | 34.2 | 8.3 | 1619 | ◎ | ○ |
| Comparative Example 1 | GN/BCN/$Al(OH)_3$/CMCNa = 40.7/49.3/5/5 | 10.8 | 2.8 | 1700 | X | ○ |
| Comparative Example 2 | GN/BCN/$Al(OH)_3$/CMCNa = 36.4/48.6/5/10 | 10.8 | 2.8 | 1601 | X | ○ |
| Comparative Example 3 | NQ/BCN/CMCNa = 30/62/8 | — | — | 1953 | ◎ | ○ |
| Comparative Example 4 | GN/BCN/CMCNa/$Al(OH)_3$ = 40.7/49.3/5/5 | 74.4 | 43.8 | 1700 | ◎ | X |

NQ: nitroguanidine.
GN: guanidine nitrate.
BCN: basic copper nitrate.
CMCNa: carboxymethyl cellulose sodium salt.

TABLE 2

| | composition (% by mass) | particle size of aluminum hydroxide (μm) D50 | D10 | combustion temperature (K) | slag-forming ability of combustion residue | ignition ability |
|---|---|---|---|---|---|---|
| Example 6 | GN/BCN/CMCNa/$Al(OH)_3$ = 40.7/49.3/5/5 | 67.2 | 36.2 | 1700 | ◎ | ○ |
| Comparative Example 5 | GN/BCN/CMCNa/$Al(OH)_3$ = 40.7/49.3/5/5 | 6.3 | 3.7 | 1700 | X | ○ |
| Comparative Example 6 | GN/BCN/CMCNa/$Al(OH)_3$ = 40.7/49.3/5/5 | 9.6 | 5.2 | 1700 | X | ○ |
| Comparative Example 7 | GN/BCN/CMCNa/$Al(OH)_3$ = 40.7/49.3/5/5 | 86.5 | 37.5 | 1700 | ◎ | X |

GN: guanidine nitrate.
BCN: basic copper nitrate.
CMCNa: carboxymethyl cellulose sodium salt.

Comparing Example 1 with Comparative Example 1, Comparative Example 2, and Comparative Example 3, it was confirmed that, when the volume mean diameter (D50) was less than 10 μm and the volume mean diameter at cumulative of 10% (D10) was less than 5 μm, a problem was found regarding the slag forming ability of the combustion residue. D50 and D10 increased in the order of Example 1, Example 2 in Table 1 and Example 6 in Table 2. The slag forming ability of the combustion residue improved accordingly.

Comparing Example 6 in Table 2 with Comparative Example 4 in Table 1 and Comparative Example 7 in Table 2, it was confirmed that, when D50 was greater than 70 μm and D10 was greater than 40 μm, the ignition ability was degraded.

The invention claimed is:

1. A gas generating composition, comprising 10 to 60% by mass of a guanidine nitrate fuel, 20 to 70% by mass of a basic copper nitrate oxidizing agent having an average particle diameter of 10 μm or less, and 1 to 20% by mass of a cooling agent which is not an iron oxide, said cooling agent being at least one member selected from the group consisting of metal hydroxide and complex salts thereof, wherein the cooling agent has a volume mean diameter at cumulative of 50% (D50) which has a particle size distribution defined with a particle size at the 50% accumulated value of 20 to 70 μm in an accumulated curve determined when the total volume of all the particles is taken as 100% and the cooling agent also has a volume mean diameter at cumulative of 10% (D10) which has a particle size distribution defined with a particle size at the 10% accumulated value of 5 to 40 μm in an accumulated curve determined when the total volume of all the particles is taken as 100%.

2. The gas generating composition according to claim 1, further comprising 0.5 to 15% by mass of a binder.

3. The gas generating composition according to claim 1, further comprising 0.1 to 5% by mass of powdered glass.

4. The gas generating composition according to claim 1, further comprising 0.1 to 5% by mass of at least one member selected from the group consisting of metal phosphates.

5. A gas generating composition, comprising 10 to 60% by mass of a guanidine nitrate fuel, 20 to 70% by mass of a basic copper nitrate oxidizing agent having an average particle diameter of 10 μm or less, and 1 to 20% by mass of a cooling agent which is not an iron oxide, said cooling agent being at least one member selected from the group consisting of metal hydroxide and complex salts thereof, wherein the cooling agent has a volume mean diameter particle size profile wherein the volume mean diameter at cumulative of (D50), defined as the particle size at the 50% accumulated value in an accumulation curve when the total volume of all the particles is taken as 100%, is selected to be 20 to 70 μm and the volume mean diameter at cumulative of 10% (D10), defined as the particle size at the 10% accumulated value in an accumulation curve when the total volume of all the particles is taken as 100%, is selected to be 5 to 40 μm.

* * * * *